US011549508B2

(12) United States Patent
Sieder

(10) Patent No.: US 11,549,508 B2
(45) Date of Patent: Jan. 10, 2023

(54) FLOW-OPTIMISED VANE PUMP

(71) Applicant: NIDEC GPM GmbH, Auengrund OT Merbelsrod (DE)

(72) Inventor: Sebastian Sieder, Coburg (DE)

(73) Assignee: NIDEC GPM GmbH, Auengrund OT Merbelsrod (DE)

( * ) Notice: Subject to any disclaimer, the term of this patent is extended or adjusted under 35 U.S.C. 154(b) by 230 days.

(21) Appl. No.: 15/733,360

(22) PCT Filed: Nov. 15, 2018

(86) PCT No.: PCT/EP2018/081437
§ 371 (c)(1),
(2) Date: Jul. 9, 2020

(87) PCT Pub. No.: WO2019/137664
PCT Pub. Date: Jul. 18, 2019

(65) Prior Publication Data

US 2021/0115920 A1 Apr. 22, 2021

(30) Foreign Application Priority Data

Jan. 12, 2018 (DE) ..... 10 2018 100 614.4

(51) Int. Cl.
*F04C 2/344* (2006.01)
*F04C 14/22* (2006.01)
*F04C 15/00* (2006.01)

(52) U.S. Cl.
CPC ..... *F04C 2/3442* (2013.01); *F04C 14/223* (2013.01); *F04C 15/0049* (2013.01);
(Continued)

(58) Field of Classification Search
CPC .. F04C 2/3442; F04C 14/223; F04C 15/0049; F04C 2210/206; F04C 2240/20; F04C 2240/30; F04C 2270/145
See application file for complete search history.

(56) References Cited

U.S. PATENT DOCUMENTS 5,501,586 A * 3/1996 Edwards ..... F01C 20/14 418/265
2010/0303660 A1* 12/2010 Konishi ..... F04C 14/226 418/31

(Continued)

FOREIGN PATENT DOCUMENTS

CN 1719037 A 1/2006
CN 102797674 A 11/2012

(Continued)

OTHER PUBLICATIONS

"German Application No. 10 2018 100 614.4, Search dated Nov. 2, 2018", (Nov. 2, 2018), 6 pgs.

(Continued)

*Primary Examiner* — Charles G Freay
(74) *Attorney, Agent, or Firm* — Schwegman Lundberg & Woessner, P.A.

(57) ABSTRACT

The invention relates to a vane pump for conveying liquids, in particular viscous oils, which vane pump includes: a rotor having sliding slots in which movable vanes are held and can be countersunk in relation to a rotor radius (r); a pump housing including a pump chamber, which encloses the rotor; and an inlet and an outlet, which open into the pump chamber at at least one end face of the rotor; radial elevations protruding, with respect to the sliding slots, over the circumference of the rotor, which elevations form a rotor radius (r) on either side of the vanes that can be countersunk, and radial pockets being recessed, relative to the rotor radius (r), between the radial elevations. Within the radial elevations, recesses are formed on the at least one end face of the rotor at which the inlet and the outlet open, which recesses provide rotating anticipatory control geometry for reducing pressure spikes in the vane cells.

9 Claims, 6 Drawing Sheets

(52) U.S. Cl.
CPC .... *F04C 2210/206* (2013.01); *F04C 2240/20* (2013.01); *F04C 2240/30* (2013.01); *F04C 2270/145* (2013.01)

(56) References Cited

U.S. PATENT DOCUMENTS

| | | | | |
|---|---|---|---|---|
| 2012/0045355 | A1* | 2/2012 | Morton | F01C 21/0863 418/26 |
| 2018/0149153 | A1* | 5/2018 | Akatsuka | F04C 11/001 |

FOREIGN PATENT DOCUMENTS

| | | | |
|---|---|---|---|
| CN | 203809289 | U | 9/2014 |
| DE | 102007061833 | A1 | 9/2008 |
| DE | 102007018692 | A1 | 10/2008 |
| DE | 102008006289 | A1 | 7/2009 |
| DE | 102011018394 | A1 | 10/2012 |
| DE | 112015000504 | T5 | 12/2016 |
| DE | 102016124104 | A1 | 6/2018 |
| JP | 2012021430 | A | 2/2012 |
| WO | WO-2010123556 | A2 | 10/2010 |
| WO | WO-2019137664 | A1 | 7/2019 |

OTHER PUBLICATIONS

"International Application No. PCT/EP2018/081437, International Search Report and Written Opinion dated Mar. 4, 2019", (Mar. 4, 2019), 12 pgs.
"Chinese Application No. 201880085591.3, First Office Action dated Aug. 4, 2021", (Aug. 4, 2021), 8 pgs.

* cited by examiner

FLOW-OPTIMISED VANE PUMP

PRIORITY CLAIM TO RELATED APPLICATIONS

This application is a U.S. national stage filing under 35 U.S.C. § 371 from International Application No. PCT/EP2018/081437, filed on 15 Nov. 2018, and published as WO2019/137664 on 18 Jul. 2019, which claims the benefit under 35 U.S.C. 119 to German Application No. 10 2018 100 614.4, filed on 12 Jan. 2018, the benefit of priority of each of which is claimed herein, and which applications and publication are hereby incorporated herein by reference in their entirety.

The present invention relates to a flow-optimized vane pump having a reduced pulsation of a pressure in the vane cells.

In contrast to centrifugal pumps, rotary displacement pumps, such as e.g. vane pumps, generate in principle a pressure pulsation which is produced from the sequence of intake and displacement cycles during one revolution of the pump shaft. The pulsation relates both to the initial pressure of the pump and the flow behaviour during the load change of the flow being conveyed into and out of the vane cells to the inlet and outlet, and also to a pressure within the vanes which close in the meantime. In general, a pulsating pressure in closed volumes or circuits leads, in a hydraulic system, to problems such as reduced durability of sealing points or noise development with perceptible resonance.

The prior art discloses vane pumps having different, application-specific geometries which are aimed at reducing pulsations. For example, DE 11 2015 000 504 T5 describes a vane pump for use in a power steering mechanism of a vehicle. The pump chamber occupies an inner contour with two radial raisings. The inlets and outlets are arranged on the face side with respect to the rotor and the slidingly mounted blocking vanes. A side plate which serves as a control plate has, on the face side turned towards the rotor 2, a notch in the direction opposite the direction of rotation, which allows an earlier, gradually increasing opening cross-section with respect to the outlet.

Said document thus describes the implementation of a static servo control geometry which is incorporated on a fixed control plate of the pump. Such a modification of the pump geometry which produces an open transition of the vane cell between intake and displacement in each working stroke can influence the volumetric efficiency of the pump in a detrimental manner.

The measure cited from the prior art is aimed at avoiding fluctuations in the pump outlet and serves for the optimized provision of an as constant as possible conveyance pressure from a vane pump, as is desired e.g. for the precise activation of linear, i.e. non-rotatory, hydraulic actuators.

An object of the present invention is that of providing an alternative optimization of the pump geometry which also effects a reduction in a pulsation within the vane cells of a vane pump.

The object is achieved by a vane pump having the features of claim 1.

The vane pump for conveying liquids, particularly viscous oils, comprises: a rotor having sliding slits into which slidable vanes are accommodated and retractable with respect to a rotor radius; a pump housing having a pump chamber encompassing the rotor, the inner contour of which comprises a hollow cylinder that is excentric to the rotor radius and/or has at least a radial raising with respect to the rotor radius in the direction of rotation of the rotor; so that vane cells that respectively take up a revolving partial volume of the pump chamber between two adjacent vanes pass through a volume increase and a volume decrease in dependence upon the radial inner contour of the pump chamber; and an inlet in the rotational angle range of the volume increase and an outlet in the rotational angle range of the volume decrease which open at least towards a face side of the rotor into the pump chamber; wherein across the circumference of the rotor, radial raisings protruding towards the sliding slits form a rotor radius to either side of the retractable vanes, and, between the radial raisings, radial pockets are recessed with respect to the rotor radius.

The vane pump is characterized particularly in that within the radial raisings at the at least one face side of the rotor, to which the inlet and the outlet open, recesses are formed.

In accordance with the invention, for the first time on a vane pump a dynamic servo control geometry is applied which is achieved by modifying a rotating control plate at the rotor of the vane pump, as explained hereinafter.

The recesses on the face sides of the radial raisings of the rotor produce, in a rotational angle range between the outlet opening and the inlet opening, in which the revolving vanes move in a closed manner through the pump chamber, a time-extended, larger connection cross-section of the volume of the vane cells initially to the outlet opening and subsequently to the inlet opening. As a result, a completely closed volume displacement, i.e. in particular a closed volume change, is shortened or is omitted, thereby effectively reducing the generation of short-term high pressure peaks in revolving vane cells.

Even if a distance between the inlet and outlet is selected in respect of the measurement of a vane cell located therebetween in order to minimize the effective distance of a closed volume displacement or volume change of a vane cell, a small cross-section which limits a pressure increase within the vane cell remains at the optionally simultaneous points in time of a volume closure and volume opening of the vane cell through the face-side recesses in the rotor.

At the same time, in dependence upon the designated viscosity of the medium and the dimension of the recesses, a sufficient sealing effect is achieved at the small cross-section of the recesses so as to prevent a hydraulic short-circuit between the inlet and outlet during passage through the vane cell and a deterioration in the volumetric efficiency is suppressed.

Advantageous developments of the vane pump in accordance with the invention are the subject matter of the dependent claims.

According to one aspect of the invention, the recesses comprise, in a radial direction, at least two adjacent radial portions that differ from one another with reference to a depth of the recess with respect to the surface of the face side of the rotor. Therefore, it is possible to establish different functional or flow-effective regions in the recesses, particularly in relation to a sealing distance of the vane cell to the inlet and outlet opening.

According to one aspect of the invention, a radial portion of the recesses which is located further inwards in the radial direction of the rotor comprises a larger depth, and an adjacent radial portion of the recesses which is located further outwards in a radial direction of the rotor comprises a smaller depth. As will be explained later, the portion with the larger depth can assume the function of a pressure-limiting equalisation channel and the portion with the smaller depth can assume the function of a flow-resistance which specifies a lower threshold value for a pressure equalisation.

According to one aspect of the invention, a contour of the recesses or of a radial portion of the recesses can be constant along the circumferential direction of the rotor. Therefore, the behaviour of a flow-effective function of the face-side recesses is neutral with respect to the rotational angle of the rotor.

According to one aspect of the invention, the recesses or a radial portion of the recesses can form a groove having an oblong, V-shaped or U-shaped contour. Such contours in a rotationally symmetrical configuration of the recess facilitate simplified manufacture of the rotor, such as e.g. by machining the recess on the rotating workpiece. In the case of manufacture by means of a sintering process, said cross-sectional contours of the recesses ensure that a moulding tool without undercuts can be detached from the unmachined part contour of the rotor. In particular, however, by selecting said cross-sectional contours of the recesses, a flow behaviour can be influenced geometrically and thus adapted e.g. to a viscosity of the medium.

According to one aspect of the invention, a distance between a mouth of the inlet and a mouth of the outlet into the pump chamber essentially corresponds to the distance between two vanes. Therefore, a distance travelled by a closed volume of a vane cell is minimized and an effective working distance of the vane cells is maximized. As a result, a duration of a closed volume change is minimized and so the points in time of a volume closure and a volume opening substantially coincide with one another. A pressure peak can be suppressed by means of the additional pressure-equalising effect of the recesses in accordance with the invention during a substantially simultaneous volume closure and volume opening in such an arrangement of the mouths of the inlet and outlet.

According to one aspect of the invention, a hydraulic pump for generating a constant pressure for hydraulic actuators or drives can comprise the vane pump in accordance with the invention. As explained above, the recesses effect a reduction in the pulsation of the pressure in the vane cells which itself occurs in combination with a medium of higher viscosity than water, such as e.g. with a hydraulic oil, and effects noise suppression in closed circuits, such as e.g. a hydraulic system.

According to one aspect of the invention, such a hydraulic pump for generating a constant pressure can have a volumetrically variable pump geometry, wherein a distance is settable between the rotor radius and the inner contour of an excentric hollow cylinder or a radial raising of the pump chamber by means of an actuator. In types of variable pumps, a pulsation of the pressure within the vane cells has a detrimental effect upon the service life because the pressure fluctuations can be transmitted via an adjustable pump chamber wall directly to the actuator for the volumetric adjustment of the pump. Therefore, the pulsation during pump operation applies a constant vibration loading against the actuating force, whereby a bearing of the adjustable pump geometry and the actuator itself are subjected to vibrations. Since corresponding kinematics are subjected to stringent requirements in relation to sealing, and by means of vibrations per se close more rapidly than a rigid geometry, a volumetrically adjustable vane pump benefits to a particular extent from an inventive modification for reducing the pulsation of the pressure within the vane cells.

According to one aspect of the invention, such a hydraulic pump can be used as a drive source in a hydraulic steering assistance system for vehicles.

The invention will be explained hereinafter with the aid of exemplified embodiments and with reference to the accompanying drawings, in which.

The structure of the vane pump in accordance with the invention will be described hereinafter with reference to FIGS. 1 to 3.

Figure 1:
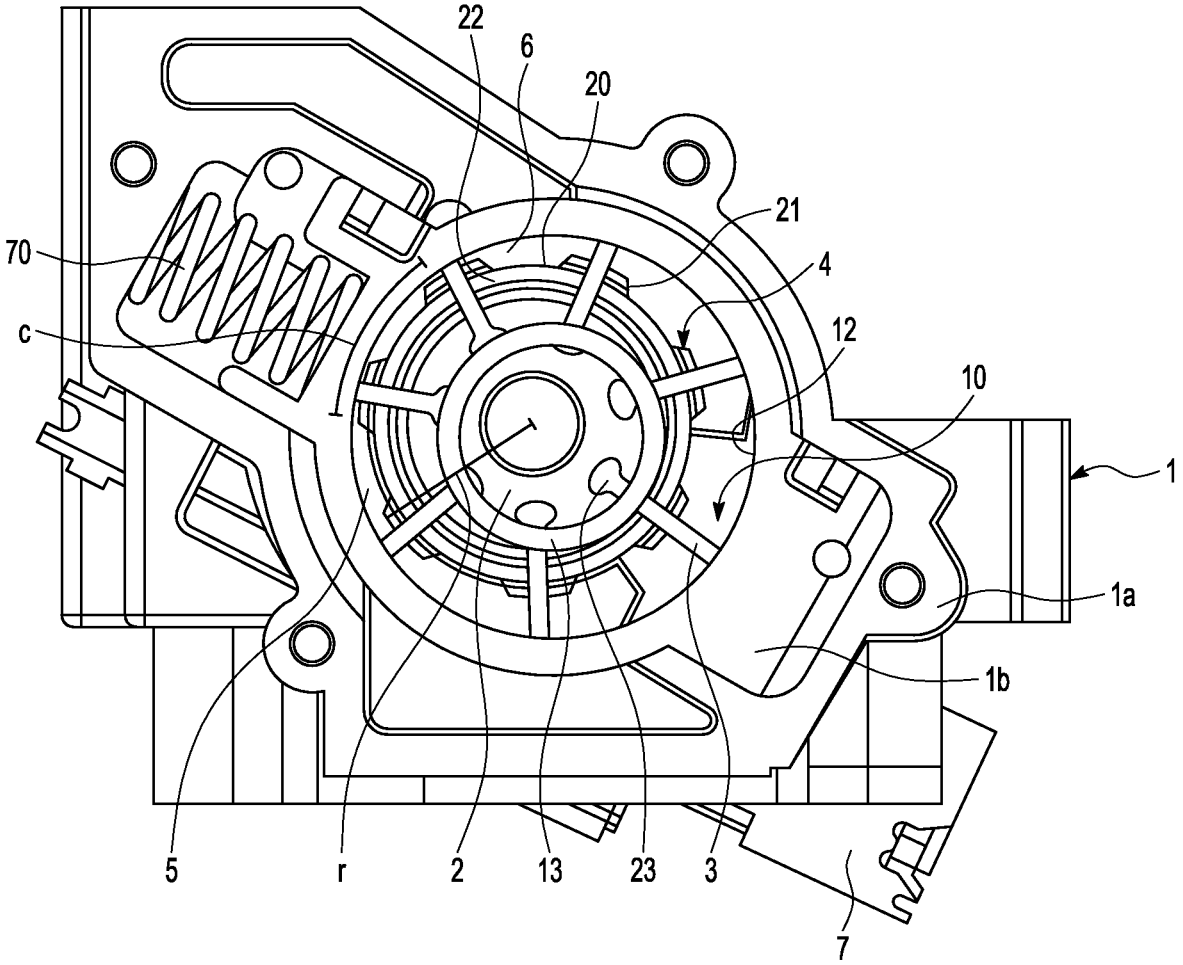
FIG. 1 shows an open plan view of a volumetrically adjustable vane pump according to a first embodiment of the invention.

FIG. 1 shows a view of an open pump housing 1 of a volumetrically adjustable vane pump, from which a pump cover has been removed. In order to be able to set the conveyed volume flow independently of a rotational speed of the pump, the pump has a variable pump geometry which is adjusted by means of a displacement between two housing parts.

An outer housing part 1*a* forms a main part of the pump housing 1 and accommodates an inlet 5, an outlet 6 and an actuator 7 with a return spring 70 therein. Furthermore, a rotor 2 is mounted in a rotatable manner on the outer housing part 1*a* and so the rotor 2 and the outer housing part 1*a* define a fixed component in relation to the adjustment movement of the variable pump geometry. A lifting ring 1*b* which comprises the pump chamber 10 is accommodated together with a guide ring 13 arranged coaxially with respect thereto as an inner housing part in a displaceable manner in the outer housing part 1*a*, and thus forms a movable component in relation to the adjustment movement of the variable pump geometry.

The lifting ring 1*b* forms a chamber wall of the pump chamber 10 in the form of a hollow cylinder. An inner contour 12 of the cylindrical pump chamber 10 extends excentrically in relation to the rotor 2, wherein a measure of the excentricity or a distance of the centre points of the pump chamber 10 and of the rotor 2 are set in dependence upon a linear displacement of the lifting ring 1*b* with respect to the outer housing part 1*a*. The adjustment movement is performed by actuating an actuator 7 which is not explained further and which generates an actuating force along the adjustment path and in so doing pretensions the return spring 70 for a reversible actuating movement.

The guide ring 13 is arranged on both sides with respect to the axial ends of the rotor 2 and concentrically with respect to the inner contour 12 of the pump chamber 10. The guide ring 13 is fixedly connected to the lifting ring 1*b* and so it always has the same excentricity as the pump chamber 10 with respect to the rotor 2 in any position of the adjustment path. The same arrangement of a guide ring 13 is provided on the opposite axial side, not illustrated, of the rotor 2.

The rotor 2 has sliding slits 23, in which radially oriented blocking vanes 3 are accommodated in a displaceably mounted manner. A radial extension of the blocking vanes 3 corresponds to a distance between the guide ring 13 and the inner contour 12 of the pump chamber 10 and so the inner ends of the blocking vanes 3 slide on the guide ring 13, and the outer ends of the blocking vanes 3 slide in the inner contour 12 of the pump chamber 10 while the blocking vanes 3 are guided through the pump chamber 10 by means of a rotation of the rotor 2 on a circular path. Moreover, since the guide ring 13 and the inner contour 12 extend excentrically with respect to the rotor 2, the blocking vanes 3 also slide in the radial direction in and out of the sliding slits 23. The blocking vanes 3 are completely retractable with respect to a rotor radius r in the sliding slits 23.

A maximum flow being conveyed by the pump is achieved if the lifting ring 1*b* is displaced together with the guide ring 13 to a maximum excentricity with respect to the rotor 2 and so the inner contour 12 almost comes into contact with a rotor radius r of the rotor 2. In such a position, a maximum volume change of the vane cells between the blocking vanes 3 is achieved during a rotor revolution of 180° in the pump chamber 10. In contrast thereto, a minimum flow being conveyed by the pump is achieved if along the adjustment path a position is taken up, at which essentially there is no longer any excentricity, i.e. a centre point of the rotor 2 and a centre point of the guide ring 13 are arranged coaxially and so the revolving vane cells within the pump chamber 10 do not undergo any volume change.

In an upper region of FIG. 1, in each case a crescent-shaped depression which forms a mouth of the outlet 6 into the pump chamber 10 extends in the face-side chamber wall of the pump chamber 10 at both axial ends of the rotor 2. Substantially axially symmetrical thereto, in a lower region of FIG. 1, in each case a crescent-shaped depression which forms a mouth of the inlet 5 into the pump chamber 10 extends likewise at the two axial ends of the rotor 2. In conjunction with the indicated anticlockwise rotational direction of the rotor 2, a volume of the vane cells decreases in the upper rotational angle range and increases in a lower rotational angle range, whereby a displacement and intake procedure is effected between the revolving vane cells and the outlet 6 or inlet 5.

A distance c is provided between an end of an opening contour of the crescent-shaped mouth of the outlet 6 and a start of an opening contour of the crescent-shaped mouth of the inlet 5 in relation to the rotational direction. Within a revolution distance of the distance c, the face-side chamber wall is in sliding contact with the blocking vanes 3 and a face surface 22 of the rotor 2.

Furthermore, the rotor 2 has on the circumference radial raisings 21 which taper towards the sliding slits 23 and define the rotor radius r of the rotor 2 at the sliding slits 23. Between the radial raisings 21, radial pockets 20 are recessed in the rotor radius r and form a clearance volume which promotes a flow behaviour and sealing of the effective working volume outside the rotor radius r in the vane cell.

If the rotor 2 rotates and the vane cells between the blocking vanes 3 are guided in a revolving manner through the pump chamber 10, the volume of the vane cells increases in the rotational angle range of the crescent-shaped mouth of the inlet 5 and so the medium being conveyed or hydraulic oil is drawn into the pump chamber 10 as long as there is a connection between the vane cell and inlet 5. In the subsequent rotational angle range of the crescent-shaped mouth of the outlet 6, the volume of the vane cells decreases and so the hydraulic oil is displaced or urged out as long as there is a connection between the vane cell and outlet 6. In a rotational angle of the distance c lying between the mouth of the outlet 6 and the mouth of the inlet 5, the volume of the vane cells is closed because in the meantime there is no connection to the inlet 5 or to the outlet 6.

If the leading blocking vane 3 of a vane cell passes through the distance c and the trailing blocking vane 3 of this vane cell moves towards the end of an opening contour of the crescent-shaped mouth of the outlet 6, a circumferential slope of the corresponding radial raising 21 initially reaches an edge at the end of an opening contour of the crescent-shaped mouth of the outlet 6 in the face-side chamber wall of the pump chamber 10. At this point in time, a connection cross-section, through which the decreasing volume of the vane cell upstream of the trailing blocking vane 3 is urged out of the pump chamber 10 to the outlet 6, is considerably reduced or already substantially closed if a setting position of the pump chamber is located on the adjustment path at an end position with respect to the rotor radius r. Subsequently, the blocking vane 3 passes beyond the end of the opening contour of the crescent-shaped mouth of the outlet 6 and completely closes a connection between the vane cell and the outlet 6. Shortly after this or essentially at the same time, the leading blocking vane 3 passes beyond an edge at the beginning of an opening contour of the crescent-shaped mouth of the inlet 5 in the face-side chamber wall of the pump chamber 10 and the closed volume of the vane cell is then opened with respect to the inlet 5. The short-term closure of the volume of the vane cell ensures a constant barrier between the crescent-shaped mouths of the inlet 5 and outlet 6 in order to preclude a hydraulic short-circuit between the inlet 5 and the outlet 6.

Figure 2:
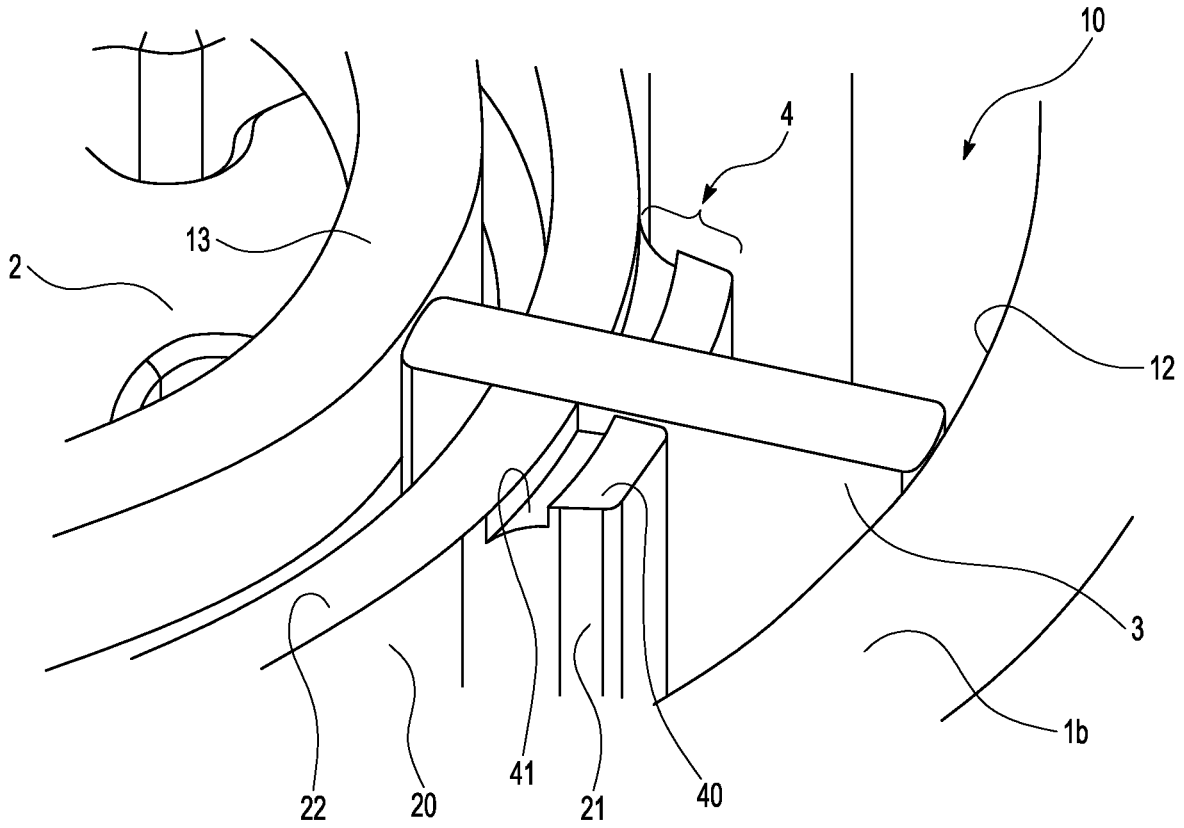
FIG. 2 shows a perspective view of a rotor having a recess according to the first embodiment of the invention.

FIG. 2 shows a recess 4 according to a first embodiment of the invention. The recess 4 extends on a face side of the rotor 2 starting from a radial pocket 20 over the radially protruding cross-section of a radial raising 21. The recess 4 is subdivided into a radially outer portion 40 and a radially inner portion 41 which differ from one another by virtue of a different depth of the recess 4. The face-side surfaces both of the inner portion 41 and the outer portion 40 of the recess 4 are recessed with respect to a radially further inwardly lying face surface 22 of the rotor 2.

If a blocking vane 3 moves towards an edge at the end of the opening contour of the crescent-shaped mouth of the outlet 6, wherein the blocking vane is inserted or retracted in the sliding slit 23 and the upstream circumferential slope of the radial raising 21 has already passed beyond the edge at the end of the opening contour, substantially no opening cross-section, through which the medium being conveyed or hydraulic oil can escape during the further volume reduction, remains at the circumference of the rotor 2. However, a small opening cross-section still remains on the face-side through the recessed surfaces of the recess 4 to the chamber wall of the pump chamber 10, whereby hydraulic oil is able to escape at a later stage before the trailing blocking vane 3 passes beyond the end of the edge of the opening contour of the crescent-shaped mouth of the outlet 6 and finally breaks a connection between the volume of the vane cell and the outlet 6. Therefore, shortly before the volume closure of the vane cells, an extended equalising flow is permitted through the recesses 4 in the face surface of the rotor 2, said flow limiting or reducing a pressure increase in the vane cells.

Within the recess 4, the inner portion 41 with the larger depth assumes the function of a channel which feeds hydraulic oil from the clearance volume of the radial pocket 20. The outer portion 40 with the smaller depth produces a defined flow resistance by reducing the size of the flow cross-section in a radial exit direction. Therefore, on the basis of the depth of the outer portion 40 and the geometry of the recess 4 it is possible to select a flow resistance to prevent a potential leakage flow which can occur for a short time through the vane cells by reason of distance c which is as short as possible and a pressure difference between the inlet 5 and the outlet 6.

Figure 3:
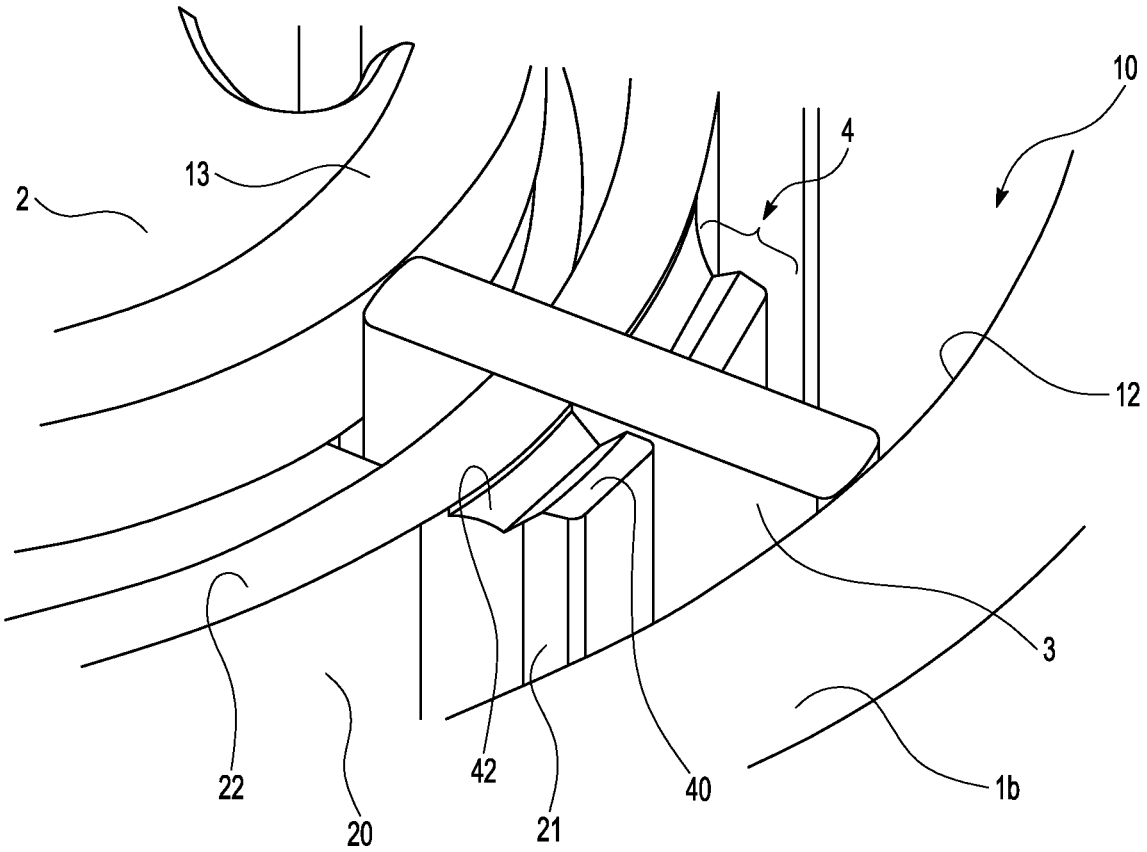
FIG. 3 shows a perspective view of a rotor having a face-side recess according to a second embodiment of the invention.

FIG. 3 shows a recess 4 according to a second embodiment of the invention. The second embodiment differs from the first embodiment by virtue of the inner portion 42 of the recess 4. Instead of the oblong or U-shaped contour of the inner portion 41 of the recess 4 of the first embodiment, the inner portion 42 of the recess 4 of the second embodiment has a V-shaped contour. Therefore, the recess 4 of the second embodiment forms a flatter graduation between the inner portion 42 and the outer portion 40, thus resulting in a larger flow cross-section. The graduation of the recess 4 according to the first embodiment or the second embodiment and the depth can be selected in a suitable manner e.g. in dependence upon a viscosity of the designated medium being conveyed or the hydraulic oil.

Figure 4:
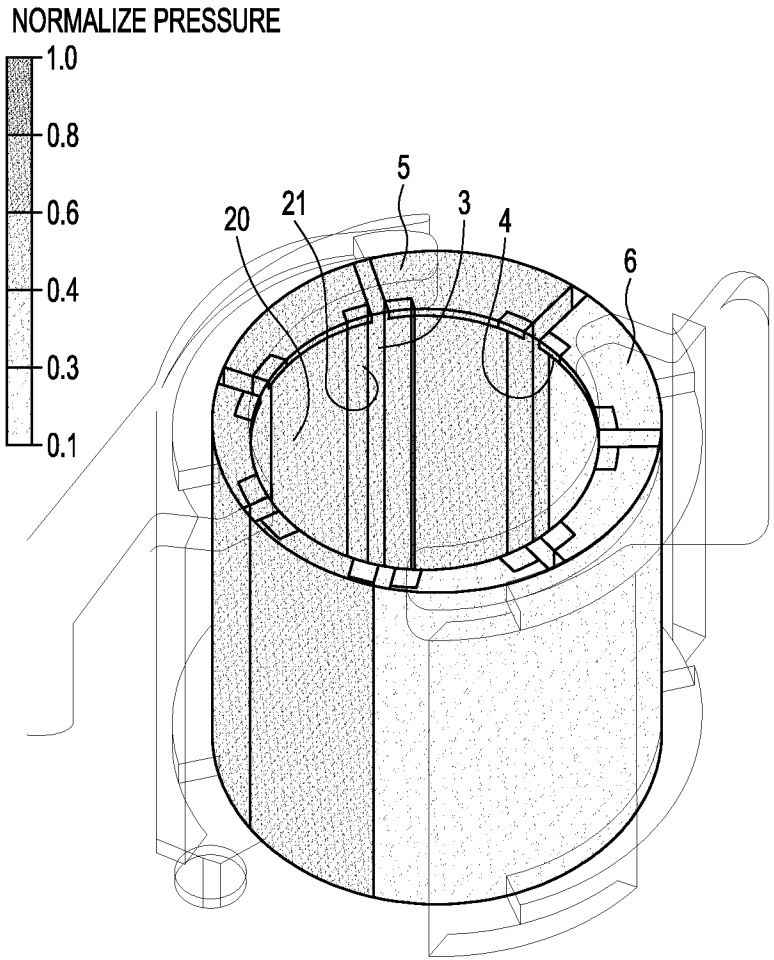
FIG. 4 shows a virtual view of a simulation of a normalized pressure progression in the pump chamber during a volume closure of a vane cell between the outlet and inlet.
Figure 4:
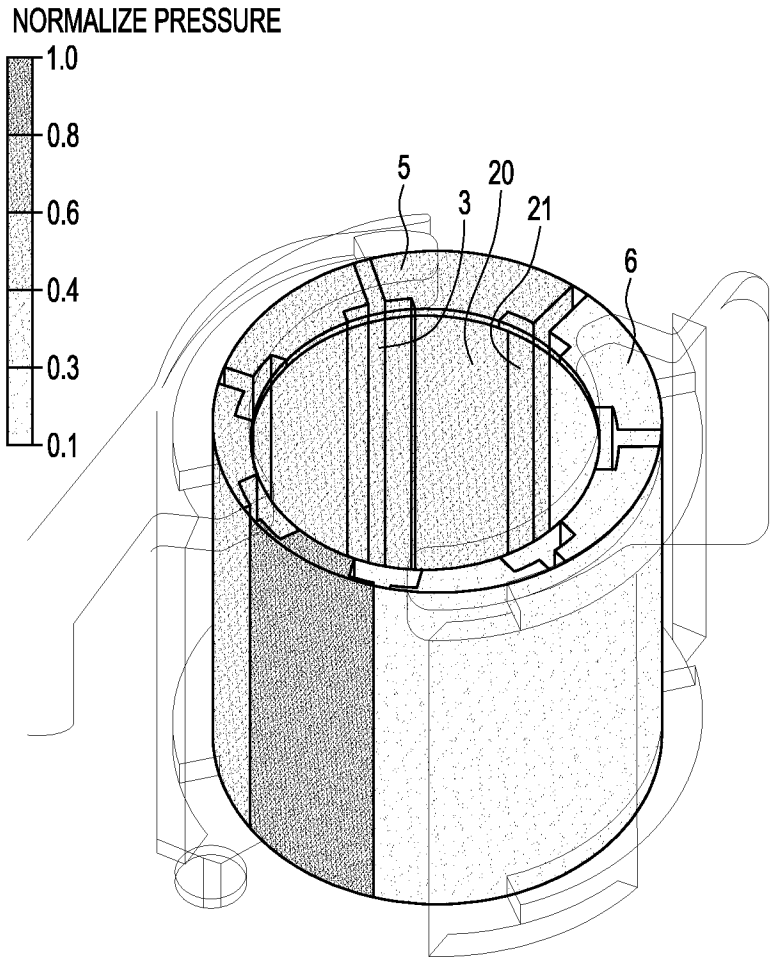

FIG. 4 shows, as a result of a virtual simulation of the pump operation, a pressure progression of the vane cells in the pump chamber 10 with reference to differently denoted regions.

On the left-hand side in FIG. 4, a pump geometry without the recesses 4 is simulated. The illustrated volumes of the vane cells correspond, in relation to the opening contours, sketched thereover, of the crescent-shaped mouths of the inlet 5 and the outlet 6, to the same rotational angle position of the rotor 2 as in FIGS. 1 and 2. From the simulation, it is evident that a pressure peak passes through a vane cell in the bottom left position which travels the distance between the mouths of the inlet 5 and the outlet 6 while the volume of the vane cell is closed. If the vane cell moves further in an anticlockwise direction, it passes into a rotational angle range of the inlet 5, in which a negative pressure prevails in the vane cell until a volume increase ends at a position opposite the region of the pressure peak. Subsequently, by reason of a volume decrease a pressure increase begins in the vane cell which ends shortly before a volume closure in the described pressure peak.

On the right-hand side of FIG. 4, the simulation shows an inventive pump geometry with recesses 4 in the face sides of the radial raisings 21 of the rotor 2. As can be seen in the perspective view of the hollow spaces in the pump chamber 10, the volumes of the vane cells fill the free spaces of the recesses 4 on both sides with respect to the blocking vanes 3 on the face-side. During the progression of the rotor rotation over time, the filled free spaces represent, in conjunction with the opening contours of the crescent-shaped mouths of the inlet 5 and the outlet 6, an extension of an opening cross-section for an equalising flow. As shown in the illustration, the virtual simulation for the pump geometry with the recesses 4 as illustrated on the right-hand side brings about a substantial reduction in the pressure peak to a level which corresponds substantially to that of the displacement phase which has been previously passed through and in which there is a complete opening to the mouth of the outlet 6.

Figure 5:
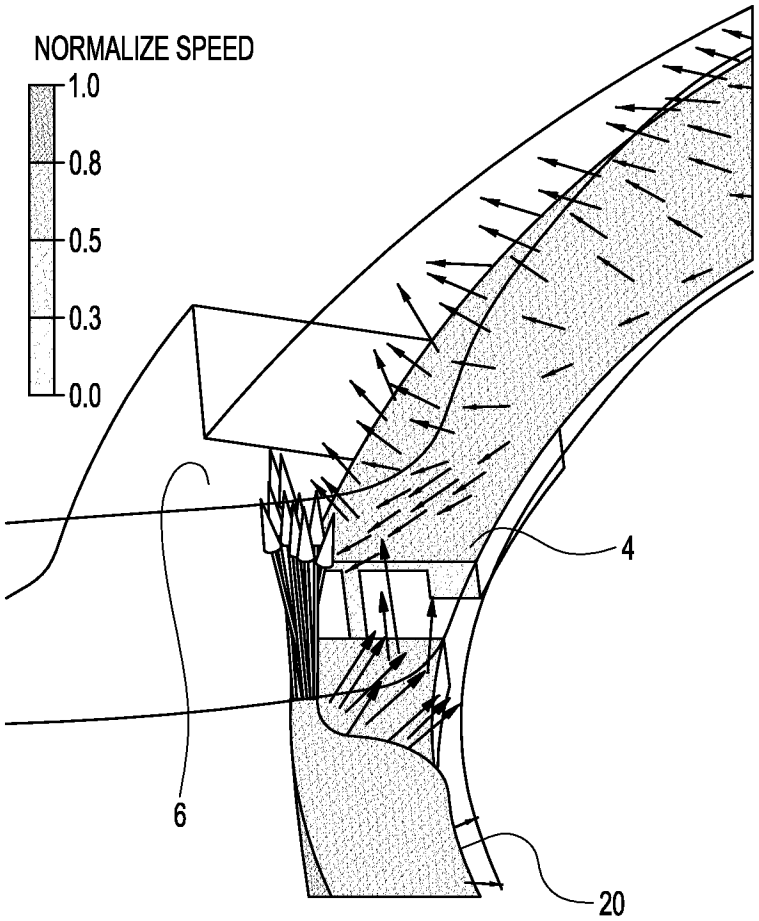
FIG. 5 shows a virtual view of a simulation of a normalized flow progression which results according to the pressure progression of FIG. 6.
Figure 5:
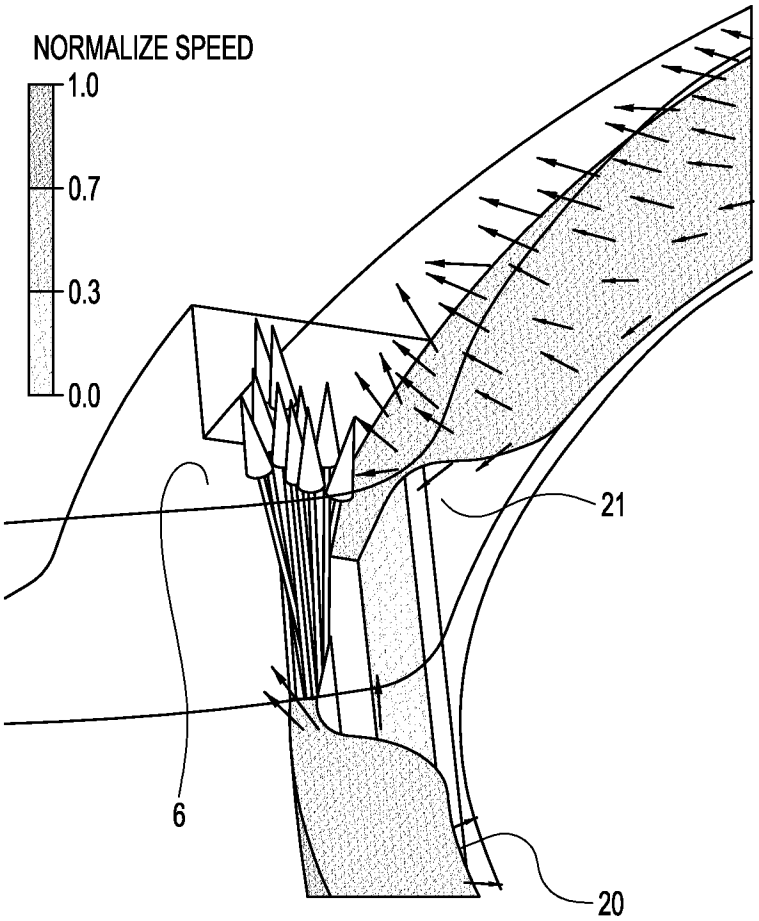

FIG. 5 shows a distribution of the pressure-equalising flow from a vane cell shortly before the volume closure, wherein the rotational angle position again corresponds to that of FIGS. 1 and 4. The size and length of the illustrated vector arrows corresponds to a flow rate or a volume flow per unit area of the flow cross-section.

In the left-hand illustration which relates to a pump geometry without the recesses 4, the vector arrows in the centre of the illustration which emerge at the edge of the opening contour of the mouth of the outlet 6 are very much larger than the vector arrows in an upper region of the illustration which represent a flow of the urging-out phase of the subsequent vane cell. This high flow rate results from the small opening cross-section which remains in an overlap of the radial raising 21 with the opening contour of the mouth of the outlet 6.

In contrast thereto, the right-hand illustration of the pump geometry with the recesses 4 illustrates the larger remaining opening cross-section between the vane cell and the outlet 6 after the radial raising 21 has already partially passed the opening contour of the mouth of the outlet 6. The upwards pointing vector arrows show that the flow rate in the critical range is still greater than that in the displacement phase of the subsequent vane cell. However, when comparing the left-hand illustration and the right-hand illustration, it can be stated that a reduction in the increase in the flow rate is achieved by the recesses 4.

Figure 6:
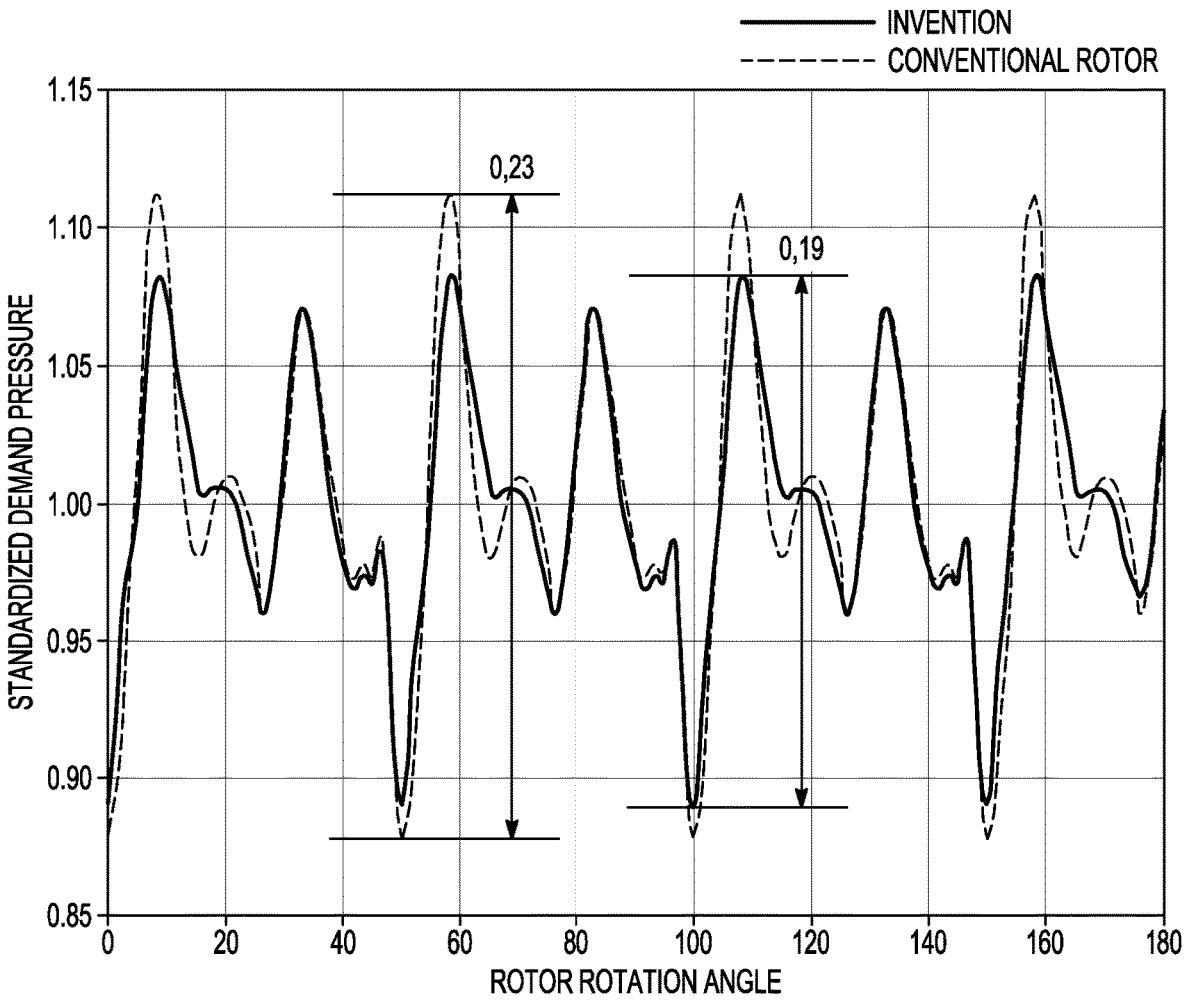
FIG. 6 shows a graph of a normalized initial pump pressure in dependence upon a rotational angle of the rotor for a vane pump in accordance with the invention and a conventional vane pump.

FIG. 6 shows a graph of an output-side conveyance pressure of the pump in dependence upon a rotational angle of the rotor 2. A broken line indicates a pressure progression for a pump geometry without the recesses 4 and a solid line indicates the pressure progression of an inventive pump geometry with recesses 4. The pressure progression and a resulting distribution of the flow rate which have been explained with FIGS. 4 and 5 propagate to the outlet 6 of the pump and accordingly produce a fluctuation in the output-side conveyance pressure of the pumps. In comparison with a conveyance pressure which is normalized to the average value and in FIG. 6 is 1.00 [–], a pressure fluctuation having a difference value of 0.23 [–] occurs in the case of a conventional rotor 2 each time a vane cell is passed, whereas the pressure fluctuation is lowered by the inventive pump geometry with recesses 4 to a pressure fluctuation having a difference value of 0.19 [–].

Apart from the illustrated and described embodiments, the vane pump for utilising the invention can likewise have a different pump housing 1. For example, the pump housing 1 can have different kinematics for the purpose of volumetric adjustment, in which between an inner contour of the pump chamber 10 and the rotor 2 a pivoting movement follows instead of a linear displacement, as is known from other types of variable pumps. Furthermore, the pump chamber 10 can have an inner contour 12 other than that of an excentric hollow cylinder. For example, the inner contour 12 of the pump chamber 10 can have at least one cam-shaped raising with respect to the rotor radius r.

The invention claimed is:

1. A vane pump for conveying liquids, comprising:

a rotor having sliding slits into which slidable vanes are accommodated and retractable with respect to a rotational axis of the rotor;

a pump housing having a pump chamber encompassing the rotor and an inner contour comprising a hollow cylinder that is excentric with respect to the rotational axis of the rotor or has at least a radial raising with respect to the rotational axis of the rotor such that vane cells that respectively take up a revolving partial volume of the pump chamber between two adjacent vanes pass through a volume increase and a volume decrease as a function of the inner contour of the pump chamber; and an inlet in a rotational angle range of the volume increase and an outlet in the rotational angle range of the volume decrease which each open at least towards a face side of the rotor into the pump chamber;

wherein across the circumference of the rotor, radial raisings protruding from the rotor towards the sliding slits form a rotor radius to each side of the retractable vanes, and, between the radial raisings, radial pockets are recessed with respect to the rotational axis of the rotor;

wherein within the radial raisings at at least one face side of the rotor, to which the inlet and the outlet open, a recess is formed.

2. The vane pump according to claim 1, wherein the recesses comprise, in a radial direction of the rotor, at least two adjacent radial portions that differ from one another with reference to a depth of the recesses with respect to the surface of the at least one face side of the rotor.

3. The vane pump according to claim 1, wherein a radial portion of the recesses which is located further inwards in a radial direction of the rotor comprises a larger depth, and an adjacent radial portion of the recesses which is located further outwards in a radial direction of the rotor comprises a smaller depth.

4. The vane pump according to claim 1, wherein a contour of the recesses or of a portion of the recesses extending in a radial direction is constant along the circumferential direction of the rotor.

5. The vane pump according to claim 1, wherein the recesses or a portion of the recesses extending in a radial direction form a groove having an oblong, v-shaped or u-shaped contour.

6. The vane pump according to claim 1, wherein a distance between a mouth of the inlet and a mouth of the outlet into the pump chamber essentially corresponds to the distance between two vanes.

7. A hydraulic pump for generating a constant pressure for hydraulic actuators or drives comprising a vane pump according to claim 1.

8. The hydraulic pump according to claim 7, further comprising:

a volumetrically variable pump geometry, wherein a distance is settable between the rotor radius (r) and the inner contour of the hollow cylinder that is excentric to the rotor axis or the radial raising of the pump chamber by means of an actuator.

9. The hydraulic pump according to claim 7, wherein the hydraulic pump is a drive source in a hydraulic steering assistance system for vehicles.

* * * * *